US012357096B1

(12) United States Patent
Longe

(10) Patent No.: US 12,357,096 B1
(45) Date of Patent: Jul. 15, 2025

(54) LIGHTWEIGHT INFLATABLE CUSHION

(71) Applicant: Greg Longe, Reno, NV (US)

(72) Inventor: Greg Longe, Reno, NV (US)

( * ) Notice: Subject to any disclaimer, the term of this patent is extended or adjusted under 35 U.S.C. 154(b) by 0 days.

(21) Appl. No.: 18/940,715

(22) Filed: Nov. 7, 2024

(51) Int. Cl.

| | |
|---|---|
| ***A47C 1/16*** | (2006.01) |
| ***A47C 4/54*** | (2006.01) |
| ***A47C 7/02*** | (2006.01) |
| ***A47C 7/14*** | (2006.01) |
| ***A47C 7/46*** | (2006.01) |

(52) U.S. Cl.
CPC ..... *A47C 7/142* (2018.08); *A47C 7/021* (2013.01); *A47C 7/467* (2013.01); *A47C 1/16* (2013.01); *A47C 4/54* (2013.01)

(58) Field of Classification Search
CPC ..... A47C 4/54; A47C 7/467; A47C 27/18; A47C 1/16; A47C 7/021; A47C 7/142
USPC ..... 297/219.1
See application file for complete search history.

(56) References Cited

U.S. PATENT DOCUMENTS 2,437,602 A * 3/1948 Hann ..... A47C 4/54 297/452.41
3,982,786 A * 9/1976 Burgin ..... B60N 2/914 297/284.3
4,078,842 A * 3/1978 Zur ..... A47C 7/021 297/284.6 X
4,169,295 A * 10/1979 Darling ..... A47C 4/54 5/706
4,504,989 A * 3/1985 Maltz ..... A47C 4/54 297/DIG. 3
4,897,890 A * 2/1990 Walker ..... A47C 27/10 5/713
4,991,244 A * 2/1991 Walker ..... A47C 27/082 5/713
5,046,205 A * 9/1991 Garcia ..... A61G 5/1091 4/456
5,277,474 A * 1/1994 Hannagan ..... A47C 4/54 5/655.3
5,412,822 A * 5/1995 Kelly ..... A47C 4/54 5/660
5,450,638 A * 9/1995 Johnson ..... A47C 27/084 297/DIG. 3 X
5,469,592 A * 11/1995 Johnson ..... A47C 27/18 297/DIG. 3 X
5,558,398 A * 9/1996 Santos ..... A47C 7/46 297/284.6
5,638,565 A * 6/1997 Pekar ..... B65D 81/052 5/710
5,769,488 A * 6/1998 Daniels ..... B62J 1/26 297/284.6

(Continued)

*Primary Examiner* — Rodney B White
(74) *Attorney, Agent, or Firm* — PERKINS COIE LLP; Colin Fowler; John Fuller

(57) ABSTRACT

An inflatable cushion that is orally inflatable using exhaled air. The inflatable cushion also can be inflated by breathing into an inflation chamber portion of the cushion and then squeezing the inflation chamber (e.g., with a user's hands and fingers), thereby increasing the pressure, to push additional air into the passages and channels to fill the seat cushion. A separate deflation chamber of the seat cushion can have a tubular check valve designed to be squeezed that opens the valve to deflate. The deflation chamber can be used to adjust the comfort of the inflatable cushion or to empty the inflatable cushion after use. The inflatable cushion can be made of thin plastic or similar material that is lightweight and can be folded, creating a structure that can be used several times before disposal.

20 Claims, 3 Drawing Sheets

(56) References Cited

U.S. PATENT DOCUMENTS 6,012,188 A * 1/2000 Daniels ..... B62J 1/12 297/284.6
6,502,263 B1 * 1/2003 Rowley ..... A47C 7/021 297/452.41
6,564,411 B2 * 5/2003 Pirzada ..... A47C 4/54 5/709
6,789,283 B2 * 9/2004 Pirzada ..... A47C 27/18 5/713
6,938,290 B2 * 9/2005 Mckinney ..... A47C 7/021 5/652
6,990,744 B2 * 1/2006 Bieganek ..... A47C 31/126 33/515
7,055,199 B2 * 6/2006 Thompson ..... A47C 7/467 5/644
7,437,789 B2 * 10/2008 Thompson ..... A47C 7/467 5/644
8,037,560 B2 * 10/2011 Goldner ..... A61G 7/1021 297/DIG. 10
8,978,693 B2 * 3/2015 Frayne ..... F16K 15/202 137/513.3
9,395,007 B2 * 7/2016 Frayne ..... F16K 15/147
9,433,301 B2 * 9/2016 Brechet ..... A47C 4/54
9,709,183 B2 * 7/2017 Frayne ..... A47C 4/54
11,766,961 B2 * 9/2023 Zhang ..... B60N 2/914 297/452.41
2013/0270881 A1 * 10/2013 Fowler ..... A61G 5/10 297/219.1
2014/0021755 A1 * 1/2014 Oates ..... B60N 2/2809 297/219.1
2014/0232155 A1 * 8/2014 Bocsanyi ..... B60N 2/914 297/284.6
2015/0335501 A1 * 11/2015 Fowler ..... A61G 5/10 297/219.1
2015/0369384 A1 * 12/2015 Frayne ..... F16K 15/202 5/706
2016/0120332 A1 * 5/2016 Chou ..... A47C 17/02 297/219.1 X
2021/0161304 A1 * 6/2021 Reinhard ..... A47C 9/002
2023/0051768 A1 * 2/2023 Steele ..... B65D 33/008
2023/0278477 A1 * 9/2023 Acome ..... A47C 7/14 297/217.3
2024/0188719 A1 * 6/2024 Liu ..... A47C 7/467

* cited by examiner

LIGHTWEIGHT INFLATABLE CUSHION

TECHNICAL FIELD

The present invention pertains to an orally inflated plastic disposable comfort cushion.

BACKGROUND

A seat cushion can improve the comfort of a person at a locale with hard seating, such as a stadium or arena. Today, most seat cushions are constructed using a heavy, durable outside layer with a foam-filled or pump-inflated pillow inside. These foam-filled models are not adjustable and are bulky to transport or store. Many inflatable models require a pump to inflate them and, sometimes, are not allowed at event venues. Further, bringing a cushion into an event venue may not be feasible, because cushions are often bulky when folded and will not fit in small handbags.

Sometimes cushions are leased or sold at an event but can be very expensive to purchase. However, sitting on or leaning against a previously used, leased cushion may be objectionable to some people due to the cushion not being as clean as they would like, or at least due to a concern that it may not be. Additionally, some event venues will not allow purses or backpacks inside that are not clear or see-through, due to the requirement for visual inspection by security personnel.

BRIEF DESCRIPTION OF THE DRAWINGS

Detailed descriptions of implementations of the present invention will be described and explained through the use of the accompanying drawings.

Figure 1:
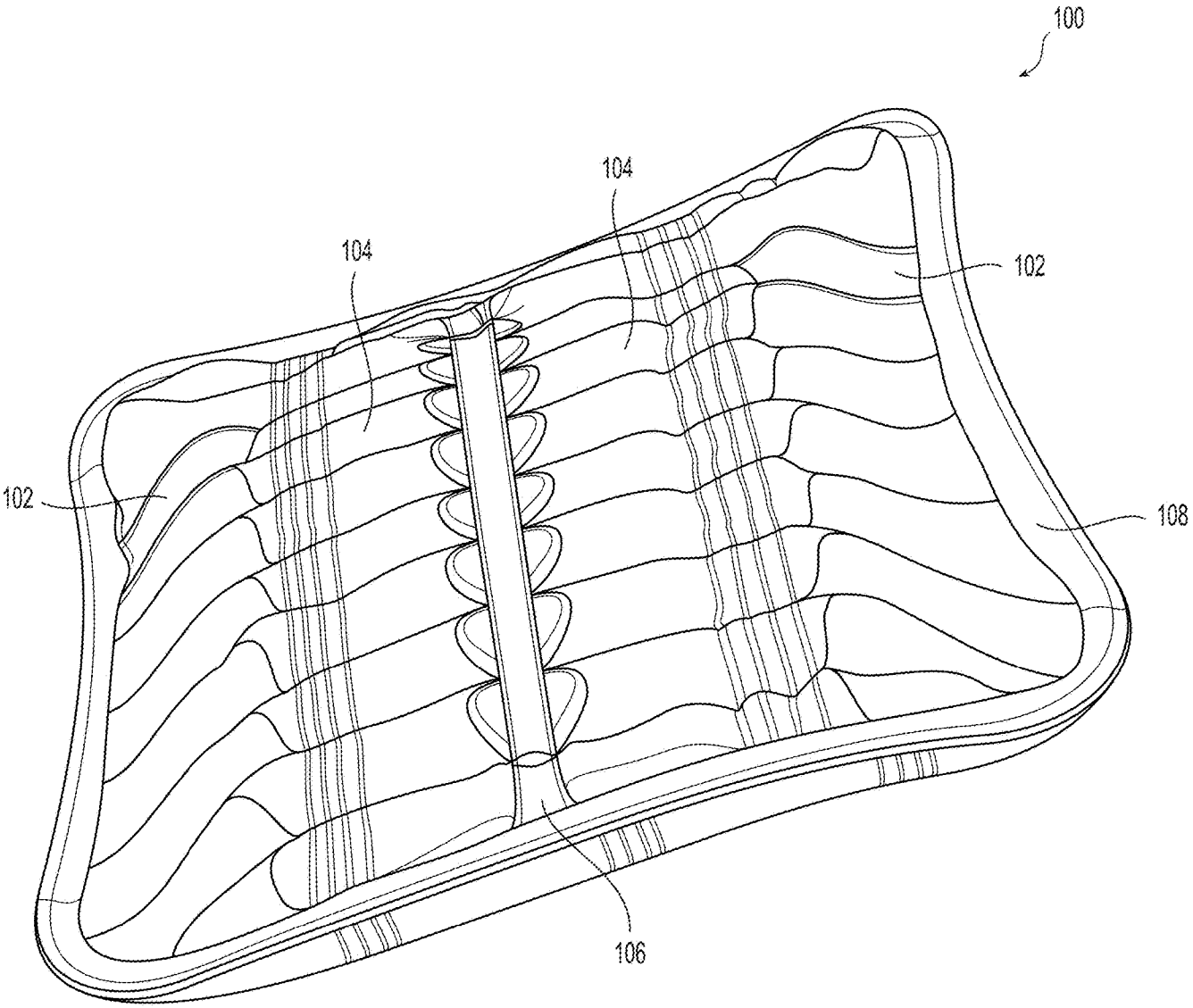
FIG. 1 illustrates a perspective view of an embodiment of a cushion.

Embodiments or implementations describing aspects of the invention are illustrated by way of example, and the same reference identifiers can indicate the same or similar elements. While the drawings depict various implementations for the purpose of illustration, those skilled in the art will recognize that alternative implementations can be employed without departing from the principles of the present technologies. Accordingly, while specific implementations are shown in the drawings, the technology is amenable to various modifications.

DETAILED DESCRIPTION

The description and associated drawings are illustrative examples and are not to be construed as limiting. This disclosure provides certain details for a thorough understanding and enabling description of these examples. One skilled in the relevant technology will understand, however, that the invention can be practiced without many of these details. Likewise, one skilled in the relevant technology will understand that the invention can include well-known structures or features that are not shown or described in detail, to avoid unnecessarily obscuring the descriptions of examples.

In view of the above-mentioned issues, a need exists for a lightweight, clear cushion that can be easily transported to a variety of different events and venues. The cushion disclosed herein is configured to support at least a portion of a person's body. In at least one embodiment, the cushion may be a seat cushion, i.e., a cushion that is designed to be sat upon by a person. The comfort of a user at any locale with hard seating, such as a stadium or arena, can be improved by using a cushion.

The disclosed cushion is a lightweight and inflatable cushion and, when not inflated, fits into most bags or pockets. The cushion, according to at least one embodiment, can provide cushioning for a user's buttocks, legs, back, or head, for example. The cushion is inflatable and includes a series of chambers and valves to provide an adjustable inflation level, enabling the user to adjust the firmness of the cushion to a desired comfort level. The cushion can be inflated orally with exhaled air from a user via an inflation chamber within the cushion. The inflation chamber facilitates the inflation of the cushion, particularly oral inflation, and makes it easier for users who may have limited breathing power (e.g., sufferers of asthma or chronic pulmonary obstructive disease (CPOD)) to inflate the cushion. The cushion can also include a deflation chamber for quickly deflating the cushion after use. The cushion can be constructed of a lightweight, thin material, such as a disposable plastic, that is strong enough to support multiple uses and inflations by the user.

Cushion

FIG. 1 illustrates a perspective view of an embodiment of the cushion 100. The cushion 100 includes multiple angled chambers 102, multiple straight chambers 104, a channel 106, and a casing 108. Using air or another gas or mixture of gases, a person (the "user") inflates the main compartment, which includes the multiple angled chambers 102 and straight chambers 104. The air can be from the user's breath or a small pump, such as a hand pump or a small electric pump. The air is transported between each angled chamber 102 and straight chamber 104 via channel 106. Channel 106 connects each angled chamber 102 and straight chamber 104 to an inflation chamber to enable air to flow to all parts of the cushion 100. The casing 108 encompasses the series of angled chambers 102, straight chambers 104, and channel 106. The casing 108 controls the size or dimensions of the cushion and prevents movement of each angled chamber 102 and straight chamber 104 relative to each other. The casing 108 can be clear or colored. In some embodiments, the casing has a design and/or text printed or embossed on it on one or both sides, such as a name and/or logo that can indicate an event, sports team, etc.

The cushion 100 can be constructed of a thin plastic material that is biodegradable and/or recyclable. For example, the plastic material can be a low-density polyethylene (LDPE). LDPE is a pliable/flexible transparent plastic material that can be manufactured to various thicknesses, which can affect the durability of the product constructed out of the material. Using a plastic material keeps the weight of the cushion 100 and construction costs low and enables disposal in common trash and/or recycling bins, such as those found in most residential homes. The entire cushion 100, including the series of angled chambers 102, straight chambers 104, channels 106, and casing 108, can be constructed from a transparent or semi-transparent material. The transparent or semi-transparent material can enable a user to bring the cushion 100 into events and venues that require visual inspection of all items by security personnel.

In some embodiments, the cushion 100 is configured to be worn like a backpack or shoulder bag. For example, the cushion may have one or more straps attached to it. When configured as a bag, the cushion 100 is constructed out of a transparent material to enable visual inspection of the cushion 100 and of any items stored in the bag. The cushion 100 can include small pockets or compartments, e.g., pockets (not shown), for storage of various items. For example, such compartments may be sized and located to allow a user to store sunblock, lotion, lip balm, cash, a credit card, and/or a water bottle. Any items stored in such compartments can be removed before the cushion is used or remain in the compartment when the compartment is located on an edge side of the cushion 100. An edge side is one of the four sides that define the inflated height of the cushion (i.e., not one of the two sides placed on either the hard surface or used to support a body part in order to provide cushioning to the user). The cushion 100 can also be configured to allow other cushions or add-ons to be attached to the cushion 100, thereby, in effect, forming one larger cushion (e.g., a full-body-sized cushion).

Figure 2:
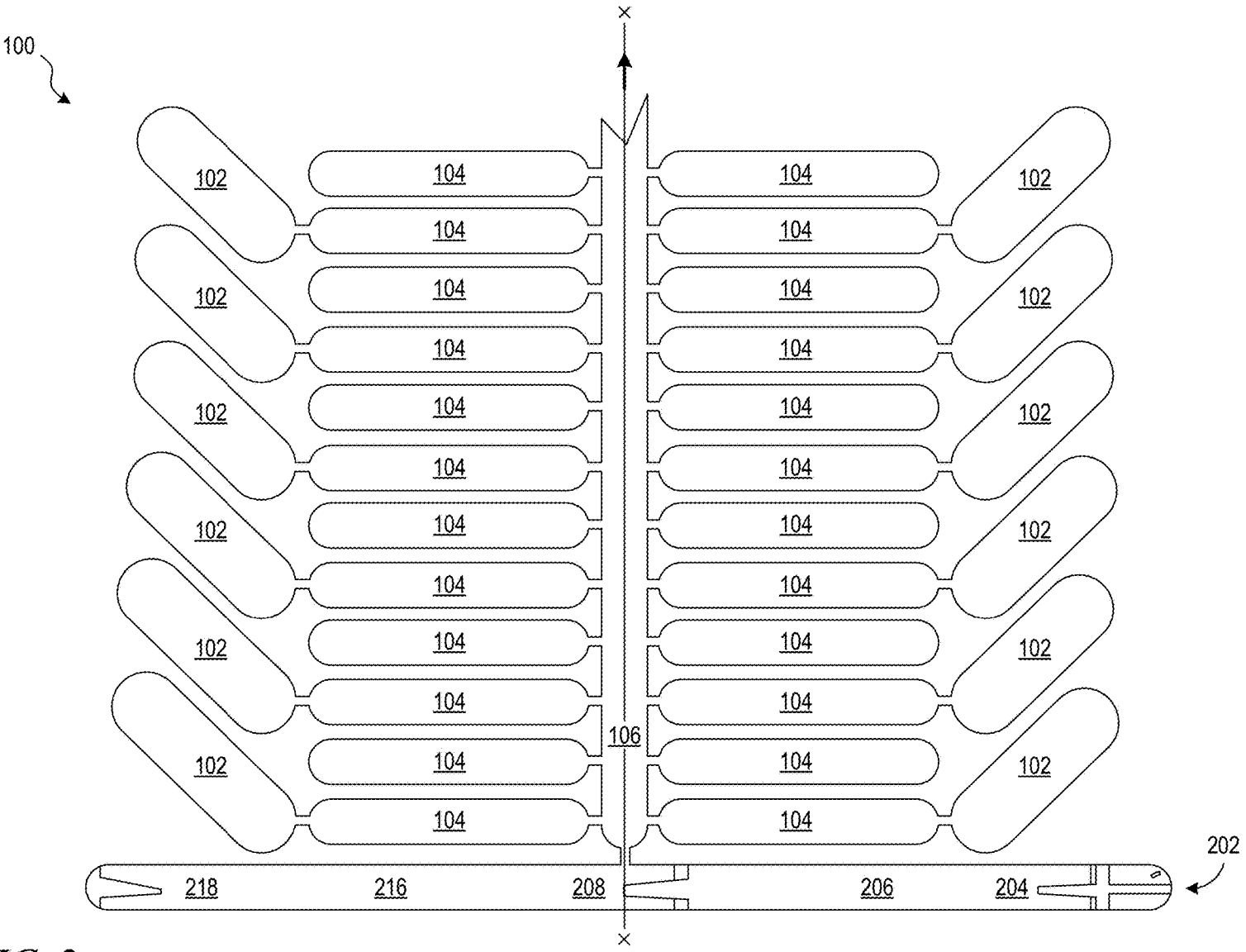
FIG. 2 illustrates a schematic view of the embodiment of the cushion of FIG. 1.

FIG. 2 illustrates a schematic diagram of an embodiment of the cushion of FIG. 1. The cushion 100 includes an inflation chamber 206, multiple straight chambers 104, multiple angled chambers 102, and a deflation chamber 216. The inflation chamber is configured to inflate the cushion 100. A user breathes air into the inflation chamber 206 using a mouthpiece 202 attached to the inflation chamber 206 at an air inlet. The air transferred into the inflation chamber 206 is directed into the multiple straight chambers 104 and multiple angled chambers 102, where the air is stored to provide cushioning. To prevent the air from escaping out of the inflation chamber 206, the cushion includes a first flat tubular check valve (check valve) 204. A check valve is a one-way valve that allows air to travel in only one direction. The check valve 204 enables a user to breathe air into the inflation chamber 206 and not have the air escape from the inflation chamber 206. A second check valve 208 is positioned between the inflation chamber 206 and the junction connecting the inflation chamber 206 to the multiple straight chambers 104, multiple angled chambers 102, and deflation chamber 216. When the user cannot solely use their breath to fully inflate or pressurize the cushion 100 to the desired firmness (e.g., due to shortness of breath), the inflation chamber 206 allows additional pressurization to be provided by the user's hands. The user breathes air into the inflation chamber 206, where the air stays between the first check valve 204 and the second check valve 208. The user then compresses (squeezes or presses on) the exterior of the inflation chamber 206 using one or both hands to overcome the pressure difference between the inflation chamber 206 and the rest of the cushion 100 and force the air past the second check valve 208. To inflate the cushion 100, the user can either first blow air into the inflation chamber and then compress the inflation chamber 206 or blow air into the inflation chamber 206 while simultaneously compressing the inflation chamber 206. The inflation chamber 206 thereby facilitates oral inflation, which is advantageous for users who may have limited breathing power (e.g., sufferers of asthma or CPOD).

After passing through the second check valve 208, the air enters channel 106. Channel 106 connects the multiple straight chambers 104 to the inflation chamber 206. Channel 106 can be positioned in the center of the cushion 100 parallel to and through axis X-X. In some embodiments, channel 106 is offset from axis X-X. The multiple straight chambers 104 extend from either side of channel 106. The number of straight chambers 104 is determined by the size of the cushion 100; for example, the larger the cushion 100, the more straight chambers 104 and subsequently angled chambers 102 there may be. The cushion 100 also includes multiple angled chambers 102. A single angled chamber 102 extends from each straight chamber 104. For example, each angled chamber 102 can be angled at 30, 45, or 60 degrees either away from or towards the inflation chamber 206. The length of each straight chamber and angled chamber determines the width of the cushion 100, while the number of straight and angled chambers determines the length of the cushion 100. The cushion 100 can be symmetrical on either side of the channel 106. The cushion 100 can be asymmetrical on either side of the channel 106 if the channel 106 is not centered on the axis X-X. In some embodiments, each straight chamber 104 is contiguous to channel 106 and each angled chamber 102. In some other embodiments, there is a small connecting passageway between each straight chamber 104 and channel 106 and each angled chamber 102. The orientation of multiple straight chambers 104 and angled chambers 102 reduces manufacturing costs while increasing comfort for the user.

The cushion 100 is deflated using the deflation chamber 216. The deflation chamber 216 includes a third check valve 218. The third check valve 218 is configured to prevent air from escaping until a user opens the third check valve 218. The user can accelerate the deflation of the cushion 100 by compressing or folding the multiple straight chambers 214 and angled chambers 102 to force the air through the third check valve 218. The deflation chamber 216 and the third check valve 218 can also allow the user to control the firmness by releasing air from the cushion 100. This enables a user to adjust the comfort level of the cushion 100 when the cushion 100 is fully inflated. The deflation chamber 216 can be the same size as the inflation chamber 206 or a different size.

The overall size or dimensions (i.e., length, width, and height) of the cushion 100 can be dependent on the cushion's 100 use case. For example, the cushion 100 can have a larger size when configured as a seat cushion or back cushion. The cushion 100 can have a smaller size when it is configured as a head cushion or feet cushion. The thickness of the cushion 100 can vary depending on the designed manner of use of the cushion 100.

Figure 3:
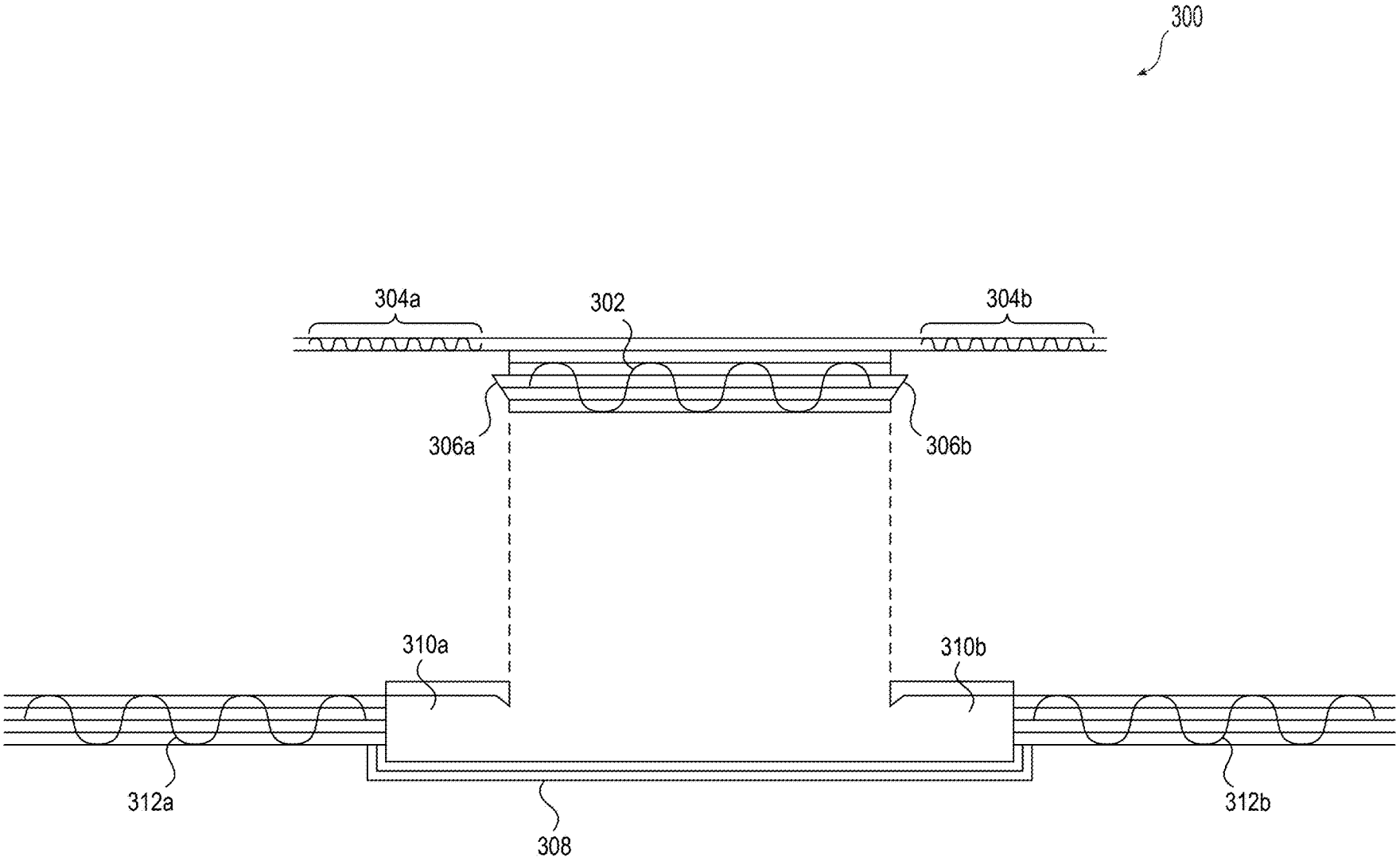
FIG. 3 illustrates an embodiment of an attachment mechanism that can be used to connect accessories to the cushion of FIG. 1.

FIG. 3 illustrates an embodiment of an attachment mechanism 300 that can be used to connect one or more accessories to the cushion 100 of FIG. 1. This attachment mechanism 300 enables a user to connect and remove accessories, such as one or more additional cushions and/or pouches for holding small items (e.g., camera, wallet, water bottle, phone, small snacks, etc.), to the cushion 100. The attachment mechanism 300 functions similarly to slide-lock closures of the type commonly used in plastic food storage bags and includes a tab portion 302 and a groove portion 308. The tab portion 302 is configured to mate with the groove portion 308. When the tab portion 302 is on the cushion 100, the groove portion 308 is on the accessory, and vice versa. The tab portion 302 is pressed into the groove portion 308 to form the connection and attach the cushion 100 to an accessory. The pressing motion forms an interlocking mechanism where the tab portion 302 fits tightly into the groove portion 308, creating a seal that can be repeatedly separated and reformed by hand. The opening of the groove portion 308 can be sized smaller than the width of the tab portion 302, so that the tab portion 302 stays connected to the groove portion 308. The groove portion 308 and the tab portion 302 can be separated by pealing the two portions apart or by applying a separating force to the attachment mechanism 300.

The tab portion 302 can include edges 306*a*, 306*b* that extend from either side of the main body of the tab portion

302. The edges 306*a*, 306*b* are configured to interlock and secure to corresponding overhangs 310*a*, 310*b* of the groove portion 308. The edges 306*a*, 306*b* fit under the overhangs 310*a*, 310*b*, which extend toward the center of the groove portion 308. The edges 306*a*, 306*b* can slightly deform to fit within the groove portion 308. The edges 306*a*, 306*b* can mate with the overhangs 310*a*, 310*b* to form the seal and the connection between the cushion 100 and an accessory. The tab portion 302 is attached to either the accessory or the cushion 100 using folded layers of heat-bonded plastic 304*a*, 304*b*. Similarly, the groove portion 308 can also be attached to either the accessory or the cushion using folded layers of heat-bonded plastic 312*a*, 312*b*. The tab portion 302 can be constructed out of folded layers of heat-bonded plastic.

The number of attachment mechanisms and the size of the attachment mechanism 300 can vary depending on the size of the cushion 100 and/or accessory. For example, a lightweight and small attachment may only require a single attachment mechanism 300 of a standard size, while a heavier or larger accessory may require multiple attachment mechanisms 300 that are one and a half to two times as large as a standard size.

I claim:

1. A cushion for a part of a body, to be placed between the part of the body and a hard surface, the cushion comprising:
- a main chamber that is inflatable;
- an inflation chamber separate from the main chamber and connected to the main chamber such that a compression action applied to an exterior of the inflation chamber when the inflation chamber is at least partially inflated causes an increase in pressure within the main chamber to facilitate inflation of the main chamber,
  - wherein the inflation chamber is defined between a first one-way valve and a second one-way valve, and
  - wherein the second one-way valve connects the inflation chamber to the main chamber, and
- a deflation chamber including a third one-way valve configured to release air from the main chamber.

2. The cushion of claim 1, wherein the deflation chamber further comprises:
- a chamber section separate from the inflation chamber and the main chamber.

3. The cushion of claim 1, further comprising:
- a mouthpiece coupled to the inflation chamber and the first one-way valve.

4. The cushion of claim 1, wherein the main chamber further comprises:
- an air chamber system that stores gas introduced into the cushion; and
- a connecting channel that connects the air chamber system to the inflation chamber.

5. The cushion of claim 4, wherein the air chamber system further comprises:
- a straight air chamber coupled to the connecting channel; and
- an angled air chamber coupled to the straight air chamber,
  - wherein the angled air chamber is angled from the straight air chamber.

6. The cushion of claim 5, further comprising:
- a plurality of straight air chambers coupled to the connecting channel; and
- a plurality of angled air chambers coupled to a corresponding straight air chamber.

7. The cushion of claim 5, wherein the air chamber system is symmetric about the connecting channel.

8. The cushion of claim 1, wherein the inflation chamber enables a user to increase a pressure inside the main chamber by applying compression to the inflation chamber to force a gas through the second one-way valve.

9. The cushion of claim 1, further comprising:
- a casing that encompasses the main chamber and the inflation chamber,
  - wherein the casing is made of a transparent or semi-transparent material.

10. An inflatable seat cushion comprising:
- a main chamber configured to provide cushioning to a user when inflated; and
- an inflation chamber separate from the main chamber and connected to the main chamber such that a compression action applied to an exterior of the inflation chamber when the inflation chamber is at least partially inflated causes an increase in pressure to facilitate inflation of the main chamber, the inflation chamber including:
  - a first one-way valve positioned at an air inlet,
  - a second one-way valve positioned at a connection point between the inflation chamber and the main chamber, and
  - an air holding section; and
- a deflation chamber separate from the inflation chamber including:
  - a third one-way valve positioned at an air outlet and the configured to release air from the main chamber, and
  - a chamber section.

11. The inflatable seat cushion of claim 10, further comprises:
- a mouthpiece coupled to the inflation chamber.

12. The inflatable seat cushion of claim 10, wherein the main chamber further comprises:
- an air chamber system that stores gas introduced into the inflatable seat cushion; and
- a connecting channel that connects the air chamber system to the inflation chamber.

13. The inflatable seat cushion of claim 12, wherein the air chamber system further comprises:
- a plurality of straight air chambers coupled to the connecting channel; and
- a plurality of angled air chambers coupled to the plurality of straight air chambers,
  - wherein the plurality of angled air chambers are angled from the straight air chamber.

14. The inflatable seat cushion of claim 13, wherein the air chamber system is symmetric about the connecting channel.

15. The inflatable seat cushion of claim 10, wherein the inflation chamber enables a user to increase a pressure inside the main chamber through applying compression to the inflation chamber to force a gas through the second one-way valve.

16. The inflatable seat cushion of claim 10, further including:
- a casing that encompasses the main chamber and inflation chamber,
  - wherein the casing is made of a transparent or semi-transparent material.

17. A seat cushion comprising:
- a main chamber that provides adjustable cushioning including:
  - multiple air chambers, and
  - a connecting channel; and
- an inflation chamber separate from the main chamber and connected to the main chamber such that a compression action applied to the inflation chamber when the inflation chamber is at least partially inflated causes an increase in pressure within the main chamber to facilitate inflation of the main chamber, the inflation chamber including:

a first one-way valve positioned at an air inlet, a second one-way valve positioned at a connection point between the inflation chamber and the main chamber, and an air holding section.

18. The seat cushion of claim 17, further comprising:

a deflation chamber separate from the inflation chamber including:

a third one-way valve positioned at an air outlet and configured to release air from the main chamber, and a chamber section.

19. The seat cushion of claim 17, wherein the connecting channel connects the multiple air chambers together.

20. The seat cushion of claim 19, wherein the multiple air chambers includes:

a straight air chamber coupled to the connecting channel; and an angled air chamber coupled to the straight air chamber, wherein the angled air chamber is angled from the straight air chamber.

* * * * *